US010641587B2

(12) United States Patent
Underwood

(10) Patent No.: US 10,641,587 B2
(45) Date of Patent: May 5, 2020

(54) BULLET TRAP

(71) Applicant: Daniel S. Underwood, Doerun, GA (US)

(72) Inventor: Daniel S. Underwood, Doerun, GA (US)

( * ) Notice: Subject to any disclaimer, the term of this patent is extended or adjusted under 35 U.S.C. 154(b) by 0 days.

(21) Appl. No.: 16/012,326

(22) Filed: Jun. 19, 2018

(65) Prior Publication Data

US 2019/0383588 A1 Dec. 19, 2019

(51) Int. Cl.
*F41J 13/00* (2009.01)

(52) U.S. Cl.
CPC ..... *F41J 13/00* (2013.01)

(58) Field of Classification Search
CPC ..... F41J 13/00; F41J 13/02
USPC ..... 273/404, 410
See application file for complete search history.

(56) References Cited

U.S. PATENT DOCUMENTS 1,844,581 A * 2/1932 Koehler ..... F41J 13/00 273/410
2,013,133 A * 9/1935 Caswell ..... F41J 13/00 273/406
2,201,527 A * 5/1940 Freeman ..... F41J 13/00 273/404
2,420,304 A * 5/1947 Diem ..... F41J 13/00 273/410
2,743,106 A * 4/1956 Schels ..... F41J 13/02 273/394
3,701,532 A * 10/1972 Nikoden ..... F41J 13/00 273/410
4,126,311 A * 11/1978 Wagoner ..... F41J 13/00 273/410
4,470,604 A * 9/1984 Hoffmann ..... F41J 13/02 102/529
5,811,718 A * 9/1998 Bateman ..... F41J 13/00 273/394
5,988,647 A * 11/1999 Porter ..... F41J 13/00 273/410
6,732,628 B1 * 5/2004 Coburn ..... F41J 13/00 273/410
7,434,811 B1 * 10/2008 Coburn ..... F41J 11/00 273/404
7,793,937 B2 * 9/2010 Bateman ..... B23K 11/0053 273/410
8,602,418 B1 * 12/2013 Hering ..... F41J 13/00 273/410
9,146,083 B2 * 9/2015 Lamothe ..... F41J 13/00
10,030,945 B1 * 7/2018 Mol ..... F41J 13/00
2007/0102883 A1 * 5/2007 Parks ..... F41J 13/00 273/348
2009/0096173 A1 * 4/2009 Bateman ..... B23K 11/0053 273/410
2012/0181752 A1 * 7/2012 Bavaro ..... F41J 13/00 273/410

* cited by examiner

*Primary Examiner* — Mark S Graham
(74) *Attorney, Agent, or Firm* — Taylor English Duma LLP

(57) ABSTRACT

A bullet trap includes a trap body defining a trap compartment, the trap body comprising a baffle plate enclosed within the trap compartment; and a funnel assembly defining an inlet, the inlet aligned with the baffle plate. A method of using a bullet trap includes firing a bullet through a throat of a trap body of the bullet trap; striking a primary baffle plate of the trap body; and redirecting the bullet towards a secondary baffle plate of the trap body.

15 Claims, 9 Drawing Sheets

BULLET TRAP

TECHNICAL FIELD

This disclosure relates to bullet traps. More specifically, this disclosure relates to a bullet trap with replaceable baffles.

BACKGROUND

Bullet traps for high-volume applications, such as a commercial shooting range, commonly use a snail-trap design. Snail traps typically comprise two funnel plates positioned relative to one another to form an inlet to a trap pipe. The funnel plates are commonly angled relative to one another to define a mouth opposite from the inlet which is significantly wider than the inlet. The angled orientation is designed to deflect or funnel bullets towards the inlet when a shooter fires at the mouth of the trap. The trap pipe defines a circular bore, and the inlet leads to the circular bore. The inlet extends longitudinally along the pipe, and the inlet is aligned tangentially with the circular bore, usually at the top of the bore, forming the shape of a snail shell. The alignment of the inlet to the circular bore is configured to redirect the bullet's linear path to a circular path within the circular bore.

In other words, if the snail trap were viewed from the side with the mouth on the left, the trap pipe on the right, and the inlet tangentially aligned with the top of the circular bore, the bullet would enter the circular bore through the inlet travelling left-to-right, and the linear velocity would be converted into a circular path travelling clockwise within the circular bore along an inner surface of the circular bore. Eventually, the kinetic energy of the bullet is exhausted through friction between the bullet and the inner surface of the circular bore, and the bullet will eventually fall to a bottom of the circular bore under the effect of gravity. The trap pipe commonly includes a bottom slot extending longitudinally along the trap pipe, and the settled bullets fall through this bottom slot into a collection mechanism to keep the circular bore clear.

Once fired, a bullet possesses an extremely high amount of kinetic energy which must be dissipated for the bullet to come to rest within the circular bore. Depending upon the cartridge, bullets can also travel at extremely high velocities, sometimes exceeding 4000 feet-per-second. As described, this energy is dissipated through friction between the bullet and the inner surface of the circular bore which generates heat. Because of the high amounts of energy being dissipated and the extreme velocities of the bullets, the trap pipe and the funnel plates must be designed to withstand abrasion. The demands of the application often require that the funnel plates and the trap pipe be fabricated from specific abrasion resistant materials, such as Abrasion Resistant ("AR") steel alloys, like AR400 or AR500, which are typically very expensive compared to common mild steel grades. These hardened materials are difficult to work with during fabrication. The transition between the funnel plates and the trap pipe must be smoothly contoured to prevent ricochet back towards the mouth of the trap which often requires the funnel plates to be welded directly to the trap pipe. This construction creates a very large, expensive, and heavy welded assembly which is difficult to transport, install, and replace at the end of its service life. Each snail trap also typically has a rating limit for the calibers which it is capable of handling, such as rimfire-only or handgun-only at the lower end up to big bore rifle caliber ratings, such as the 0.50 Browning Machine Gun ("BMG") or larger. Once fabricated, the individual snail trap is typically not upgradeable to handle more powerful calibers than those for which it was originally designed.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a bullet trap comprising a trap body defining a trap compartment, the trap body comprising a baffle plate enclosed within the trap compartment; and a funnel assembly defining an inlet, the inlet aligned with the baffle plate.

Also disclosed is a method of using a bullet trap, the method comprising firing a bullet through a throat of a trap body of the bullet trap; striking a primary baffle plate of the trap body; and redirecting the bullet towards a secondary baffle plate of the trap body.

Also disclosed is a trap body, the trap body comprising a front side, the front side defining a throat extending to a trap compartment, the trap compartment defined within the trap body; a back side, the back side disposed opposite from the front side; a pair of end plates, each end plate of the pair of end plates extending from the front side to the back side; and a baffle plate enclosed within the trap compartment, the baffle plate extending between the pair of end plates.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
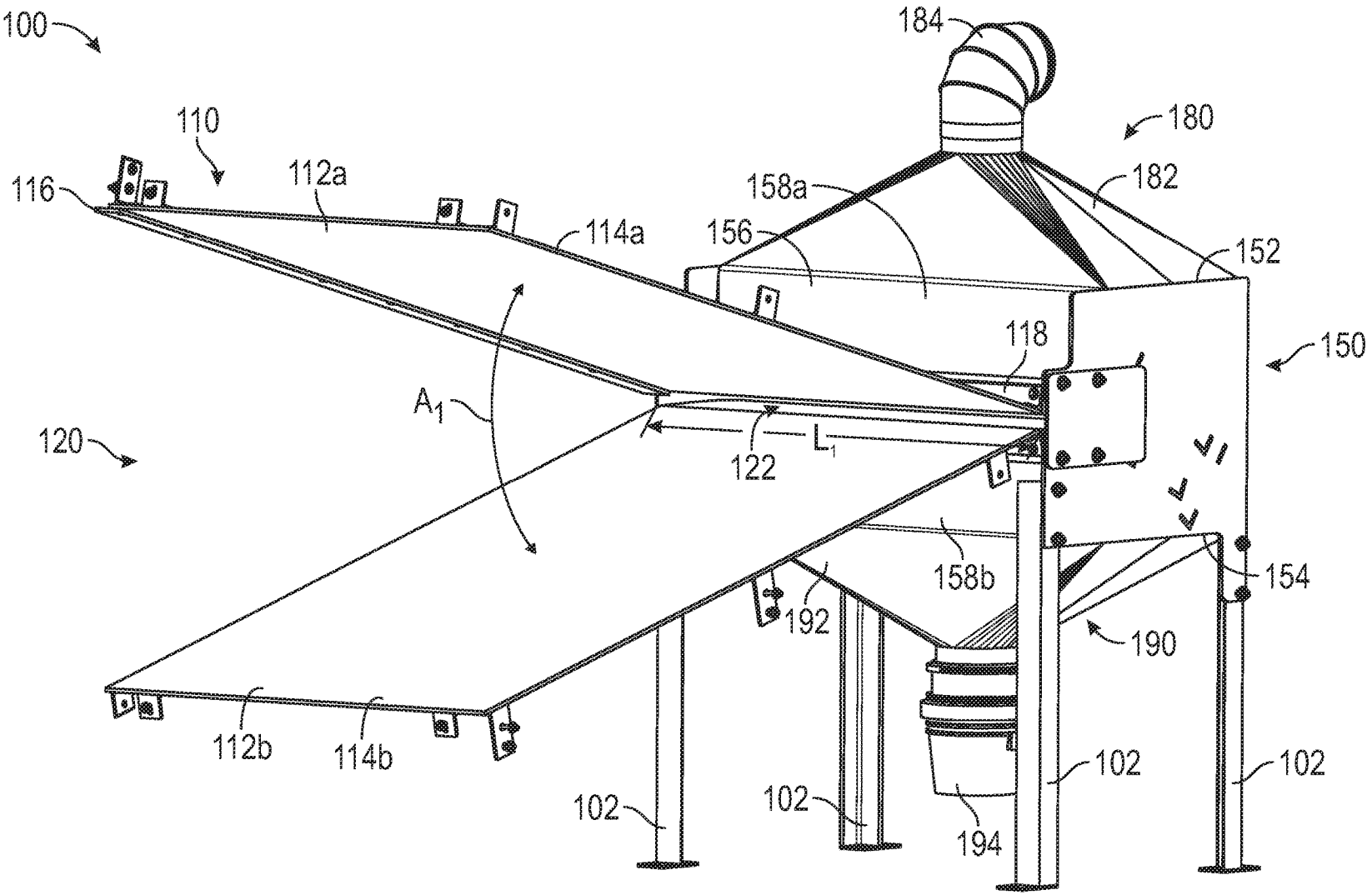
FIG. 1 is a front perspective view of a horizontal bullet trap in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a bullet trap and associated methods, systems, devices, and various apparatus. The bullet trap can comprise a funnel assembly and a trap body. It would be understood by one of skill in the art that the disclosed bullet trap is described in but a few exemplary embodiments among many. No particular terminology or description should be considered limiting on the disclosure or the scope of any claims issuing therefrom.

FIG. 1 shows a front perspective view of a horizontal bullet trap 100 in accordance with one aspect of the present disclosure. The horizontal bullet trap 100 can comprise a funnel assembly 110, a trap body 150, a vent assembly 180, and a collection assembly 190. In the present aspect, the trap body 150 can be shaped as a rectangular prism defining a trap top end 152 and a trap bottom end 154, disposed opposite from the trap top end 152. In other aspects, the trap body 150 can define a different shape, such as a triangular prism, trapezoidal prism, pyramidal shape, or any other suitable shape. The funnel assembly 110 can be attached to a front side 156 of the trap body 150. The collection assembly 190 can be attached at the trap bottom end 154. In the present aspect, the vent assembly 180 can be attached to the trap top end 152. In other aspects, the vent assembly 180 can be attached to a different side or to the trap bottom end 154; however, attachment of the vent assembly 180 to the trap top end 152 can present advantages pertaining to ventilation and filtration which are described below.

The funnel assembly 110 can comprise a pair of funnel plates 112*a,b* which can be arranged in a wedge-shaped configuration in the present aspect. The funnel plate 112*a* can be a top funnel plate 114*a*, and the funnel plate 112*b* can be a bottom funnel plate 114*b*. The front side 156 of the trap body 150 can be defined by a pair of throat plates 158*a,b* of the trap body 150, as shown and described in further detail below with respect to FIGS. 3 and 4.

The funnel assembly 110 can define a first end 116 and a second end 118, disposed opposite from the first end 116. The second end 118 can be attached to the trap body 150, and the first end 116 can be disposed opposite from the trap body 150. The funnel plates 112*a,b* can be vertically angled so that the funnel plates 112*a,b* can angle vertically inwards towards one another from the first end 116 to the second end 118. The funnel plates 112*a,b* can define a funnel angle $A_1$, and in the present aspect, the funnel angle $A_1$ can be an acute angle, such as 12 to 16 degrees for example and without limitation. In some aspects, the funnel angle $A_1$ can be greater than 16 degrees or less than 12 degrees. The funnel assembly 110 can define a mouth 120 at the first end 116 and an inlet 122 at the second end 118, and the mouth 120 can be wider than the inlet 122. In the present aspect, the inlet 122 can be defined in a horizontal orientation in which a length $L_1$ of the inlet 122 can extend horizontally (a vertical orientation of the inlet 122 is shown in FIGS. 6-9). The configuration of the funnel plates 112*a,b* and the funnel angle $A_1$ can redirect, or funnel, bullets fired at the mouth 120 into the inlet 122.

In other aspects, the funnel assembly 110 can comprise more than two funnel plates 112*a,b*. For example, in another aspect, the funnel assembly 110 could comprise four funnel plates, such as a top plate and a bottom plate angled vertically inward towards one another, and two side plates angled horizontally inward towards one another from the mouth 120 to the inlet 122. In such aspects, the funnel assembly 110 can define a pyramidal shape instead of the wedge shape, or triangular prism shape, shown in the present aspect.

The horizontal bullet trap 100 can also comprise a plurality of legs 102. In the present aspect, the legs 102 can be attached at the trap bottom end 154, and the legs 102 can support the trap body 150 and provide clearance and access to the collection assembly 190. The collection assembly 190 can comprise a collection pan 192 which can taper from the trap bottom end 154 towards a collection bucket 194. The vent assembly 180 can comprise a vent hood 182 which can taper upwards from the trap top end 152 towards a vent duct 184. In the present aspect, each of the vent hood 182 and the collection pan 192 can define a pyramidal shape, for example and without limitation.

Figure 2:
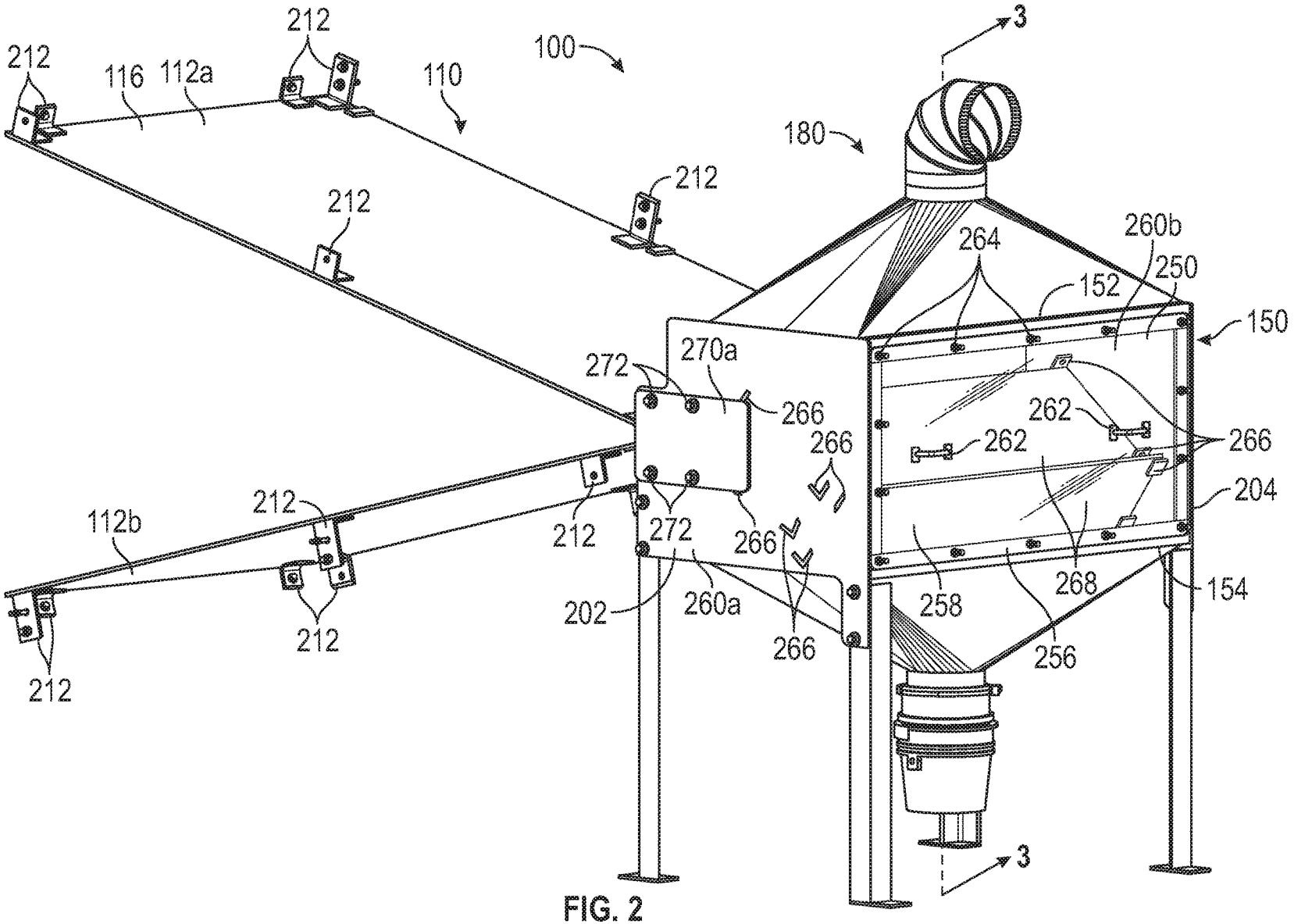
FIG. 2 is a rear perspective view of the horizontal bullet trap of FIG. 1.

FIG. 2 is a rear perspective view of the horizontal bullet trap 100 of FIG. 1. As shown, the funnel plates 112*a,b* can comprise a series of mounting brackets 212. The mounting brackets 212 can be configured to attach to structures within a shooting range (not shown) for installing the horizontal bullet trap 100 at an end of a shooting lane. The mounting brackets 212 can support the first end 116 of the funnel assembly 110 when installed.

The trap body 150 can define a back side 256 disposed opposite from the front side 156 (shown in FIG. 1). The back side 256 can be defined by a back plate 258. In the present aspect, the back plate 258 can be removable from the trap body 150, and the back plate 258 can be attached to the trap body 150 by a plurality of fasteners 264 attached around a perimeter of the back plate 258. The back plate 258 can also comprise a pair of handles 262 to facilitate installation and removal of the back plate 258.

In the present aspect, the back plate 258 can comprise a transparent material, such as bullet-proof glass, polycarbonate, acrylic, or any other suitable material. In other aspects, the back plate 258 can comprise a non-transparent material such as mild steel, AR steel, titanium, kevlar composite, or any other suitable material. In aspects where the back plate 258 is transparent, a trap compartment 250 can be viewed through the back plate 258. The trap compartment 250 can be defined within the trap body 150, and in the present aspect, the back plate 258 can form an air-tight seal with the trap body 150 to enclose the back side 256 of the trap body 150.

The trap body 150 can comprise a plurality of baffle plates 268 enclosed within the trap compartment 250, as shown through the back plate 258. In the present aspect, the trap compartment 250 can be fully enclosed with the exception of the inlet 122 (shown in FIG. 1) and the vent assembly 180. In other aspects which may not comprise the vent assembly 180, the trap compartment 250 can be completely enclosed except for the inlet 122.

Each of the baffle plates 268 can define a plate shape, such as a rectangular prism, for example and without limitation. The trap body 150 can further comprise a pair of end plates 260*a,b* disposed at opposite sides 202,204 of the trap body 150, and the baffle plates 268 can extend between the end plates 260*a,b* within the trap compartment 250. In the present aspect, the end plates 260*a,b* can be in a vertical orientation, and the end plates 260*a,b* can be positioned substantially perpendicular to the length $L_1$ of the inlet 122, the front side 156 (shown in FIG. 1), and the back side 256 of the trap body 150. The baffle plates 268 can be secured to the end plates 260*a,b* by a plurality of baffle plate supports 266. In the present aspect, the baffle plate supports 266 can comprise pieces of angle stock, such as angle iron, steel, or any other suitable material. In the aspect shown, the baffle plate supports 266 can be secured within cutouts defined by the end plates 260*a,b*, and ends of the baffle plate supports 266 can extend through the end plates 260*a,b*. In the present aspect, the baffle plate supports 266 can be welded within the cutouts to both seal and secure the baffle plate supports 266 within the cutouts. In other aspects, the end plates 260*a,b* may not define cutouts, and the baffle plate supports 266 can be secured to the respective end plates 260*a,b* by a fastener, such as a bolt, rivet, screw, or any other suitable fastener, or a technique such as welding, brazing, soldering, gluing, or any other suitable technique. In such aspects, the baffle plate supports 266 may not extend through the respective end plates 260*a,b*.

In the present aspect, the baffle plates 268 can be removable from the trap body 150, such as for inspection, replacement, or upgrade. For example and without limitation, in an aspect of the horizontal bullet trap 100 originally designed for low powered applications such as rimfire-only or pistol-caliber-only service, the baffle plates 268 can comprise a thinner and softer material, such as a low grade AR steel. If the owner or user wishes to upgrade the horizontal bullet trap 100, such as to accommodate common centerfire rifle calibers such as 0.223 Remington or 0.308 Winchester, or high-powered rifles such as 0.50 BMG, the baffle plates can be replaced with baffle plates 268 comprised of a thicker plate of high grade steel, such as AR500.

Each baffle plate 268 can simply comprise a plate material cut to the necessary dimensions, such as plate steel. AR steel alloys are hardened steel allows which can be difficult to work with, and the simple shape of the baffle plates 268 reduces wear and tear on fabrication machinery compared to the contoured and intricate shapes of a snail-trap design. Additionally, the present design minimizes welding of the AR steel plates which can be desirable because hardened alloys, such as AR steel alloys, can be more brittle and crack-sensitive compared to milder steels, and the welds can fail over time due to repeated stresses, particularly if any impurities are introduced during welding.

Additionally, because the baffle plates 268 are removable and replaceable, at the end of the service life for the baffle plates 268, the baffle plates 268 can be replaced easily and at low cost compared to the requirements of replacing an entire snail-trap design. In aspects wherein the back plate 258 is transparent, the condition of the baffle plates 268 can be observed and monitored regularly through the back plate 258 without requiring removal of the back plate 258. In some aspects, the end plates 260*a,b* can be transparent to permit observation of the enclosed baffle plates 268. In other aspects, either or both of the end plates 260*a,b* and the back plate 258 can be non-transparent but may comprise smaller viewing windows (not shown) comprising transparent materials.

In the present aspect, the trap body 150 can further comprise a pair of throat cap plates 270*a,b* (throat cap plate 270*b* shown in FIG. 3) which can respectively attach to the end plates 260*a,b* through a plurality of fasteners 272. The length $L_1$ (shown in FIG. 1) of the inlet 122 can be defined extending between the throat cap plates 270*a,b*. The throat cap plates 270*a,b* can enclose opposite ends of a throat 322 (shown in FIG. 3) which extends from the inlet 122 (shown in FIG. 1) to the trap compartment 250. In the present aspect, the throat cap plates 270*a,b* can be positioned in a vertical orientation substantially perpendicular to the length $L_1$ of the inlet 122 (FIGS. 6-9 show the throat cap plates 270*a,b* and the end plates 260*a,b* in a horizontal orientation in accordance with another aspect of the present disclosure).

Figure 3:
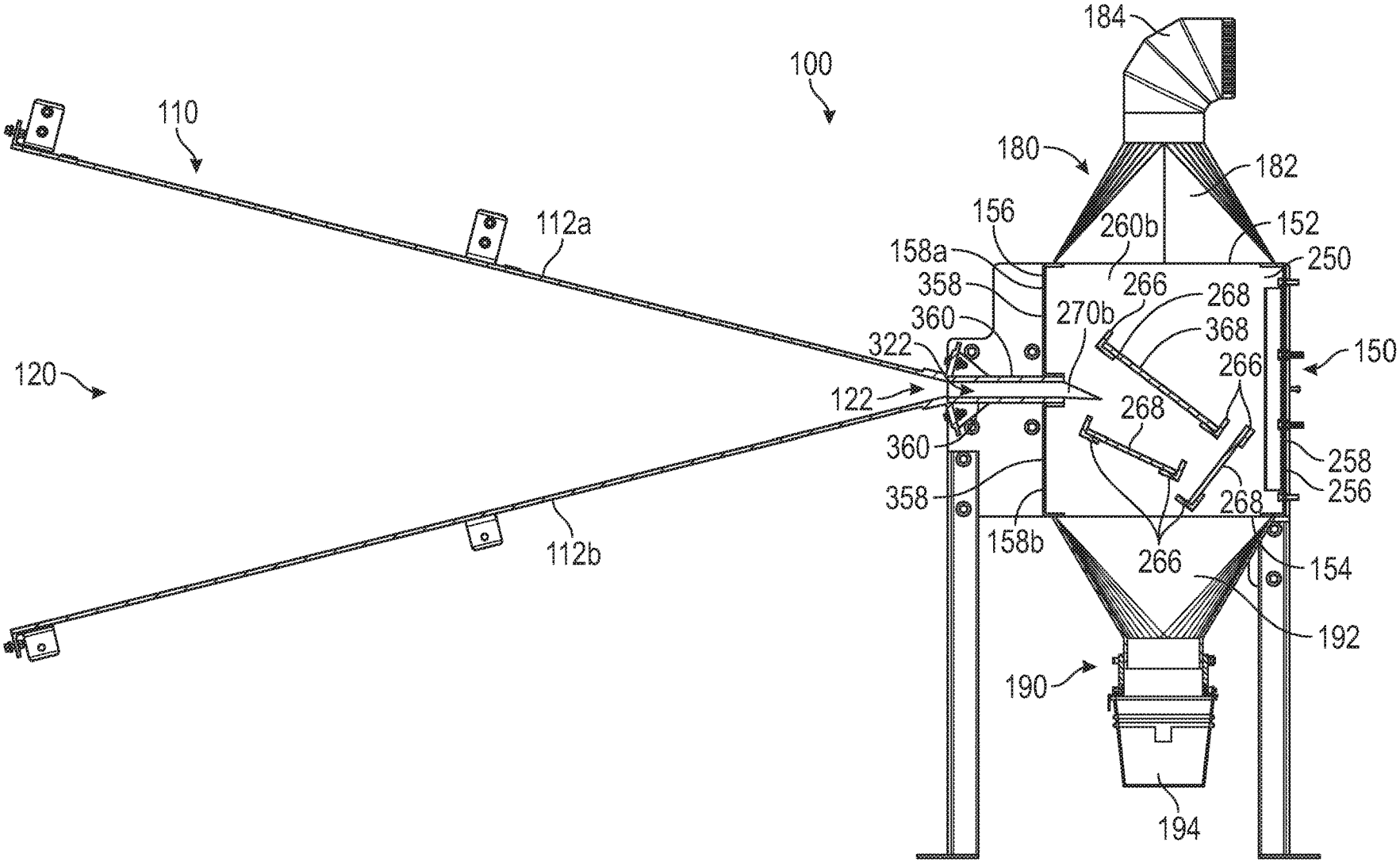
FIG. 3 is a cross-sectional view of the horizontal bullet trap of FIG. 1 taken along line 3-3 as shown in FIG. 2.

FIG. 3 is a cross-sectional view of the horizontal bullet trap 100 taken along line 3-3 shown in FIG. 2. As shown, the throat plates 158*a,b* can each respectively define a face portion 358 and a throat portion 360. In the present aspect, the face portions 358 can be substantially perpendicular to the throat portions 360; however, in other aspects, the face portions 358 can be angled at an obtuse or an acute angle relative to the throat portions 360. The throat portions 360 of the throat plates 158*a,b* can define the throat 322 extending from the inlet 122 of the funnel assembly 110 to the trap compartment 250. As shown, the throat cap plate 270*b* can cover an end of the throat 322. In other aspects, the end plates 260*a,b* (end plate 260*a* shown in FIG. 2) can cover the ends of the throat 322. In the present aspect, the throat 322 can be defined substantially perpendicular to the back side 256 and the back plate 258.

In the present aspect, the funnel assembly 110 can attach to the front side 156 of the trap body 150 with the inlet 122 and throat 322 positioned approximately midway between the trap top end 152 and the trap bottom end 154; however, this arrangement should not be viewed as limiting, and the funnel assembly 110 can attach to the front side 156 of the trap body 150 higher or lower relative to the trap body 150. The throat plate 158*a* can extend between the top trap end 152 and the inlet 122 and throat 322, and the throat plate 158*b* can extend between the trap bottom end 154 and the inlet 122 and the throat 322.

In use, a user can fire a bullet (not shown) into the mouth 120 of the horizontal bullet trap 100, and the bullet will be guided by the funnel plates 112*a,b* through the inlet 122, then through the throat 322, and then into the trap compartment 250 where the bullet will strike one or more of the baffle plates 268. In the present design, the kinetic energy of the bullet is dissipated by impact with the baffle plates 268, and often the bullet may fragment or disintegrate into tiny particles. Whole bullets, fragments, or particles can fall down under the force of gravity through the trap bottom end 154 of the trap body 150 and into the collection pan 192. The collection pan 192 can be sloped inward and downward towards the collection bucket 194 which can receive the bullets, fragments, and particles. The collection bucket 194 can be removed to dispose of the bullets, fragments, and particles.

One benefit of the present design is that impact with the baffle plates 268 often separates a jacket of the bullet from a core of the bullet which can aid in recycling. Many common bullets utilize a jacketed construction in which a heavy, soft core material, such as lead, is enclosed by a harder jacket material, such as copper, brass, or mild steel. Separating the core materials from the jacket material can simplify recycling of the raw materials comprised by the bullet.

Firing ammunition can produce smoke and gases which are unhealthy to breathe. Additionally, primers used in ammunition can contain toxic materials, including lead and other heavy metals which can be introduced into the air upon firing. Additionally, many bullets contain lead, and the impact of the bullet with the baffle plates 268 can create lead dust and particles which can at times be small enough to become suspended in air. As a result, many shooting ranges utilize special ventilation systems which push air into the shooting range lanes behind the shooter and return the air through vents located downrange. This arrangement pushes the smoke, toxic fumes, and particles downrange and away from the shooter. In the present aspect, the horizontal bullet trap 100 can be designed so that air flow coming downrange towards the horizontal bullet trap 100 can pass through the inlet 122 and into the trap compartment 250. The air flow can then be directed upwards through the vent hood 182 and out of the vent duct 184 of the vent assembly 180.

With the exception of the inlet 122 and the vent duct 184, the horizontal bullet trap 100 can be sealed to be air-tight to prevent particles generated within the trap compartment 250 from bullets striking the baffle plates 268 from escaping the horizontal bullet trap 100. Indoor shooting range ventilation systems often require industrial grade air filters to remove particulate from the returned air, such as lead particles. With the vent assembly 180 positioned on top of the trap body 150, the horizontal bullet trap 100 can be designed to act as a gravitational vertical separator to limit the size of the particles returned through the vent duct 184 to the ventilation system, thereby increasing the useful life of filters within the ventilation system.

Calculations for sizing a vertical separator are well known in the art. For example, a maximum particle size to be returned through the ventilation system can be set for a given material (for example the maximum diameter of a spherical lead particle), and Stoke's Law can be used to determine the settling velocity of the particle in air. So long as the vent assembly 180 is sized so that the upwards velocity of air flowing outwards through the vent assembly 180 is lower than the settling velocity of the maximum particle size, particles larger than the maximum particle size will settle out of the air flow and into the collection assembly 190 under the force of gravity. In some aspects, the vent assembly 180 can comprise an open, course filter (not shown) to knock down any larger particles which may be ejected upwards upon bullet collision with the baffle plates 268. Additionally, a primary baffle plate 368 of the plurality of baffle plates 268 can define a primary strike surface 422 (shown in FIG. 4). The primary baffle plate 368 can be the first baffle plate 268 to be struck by a bullet passing through the throat 322. The primary strike surface 422 can be substantially planar, and the primary strike surface 422 can be angled downwards so that any particles created by an initial impact with the primary baffle plate 368 will be directed downwards towards the collection assembly 190. Through the sizing equations described above and the downward orientation of the primary baffle plate 368, the horizontal bullet trap 100 can offer improved performance over many snail-trap designs in terms of separating particles from the air flow returned to the ventilation system.

In other aspects, the horizontal bullet trap 100 may not comprise the vent assembly 180. In such aspects, the trap top end 152 can be sealed, such as by a plate, for example and without limitation. In such aspects, downrange return ventilation can be accomplished such as by ceiling return vents disposed in front of the funnel assembly 110.

Figure 4:
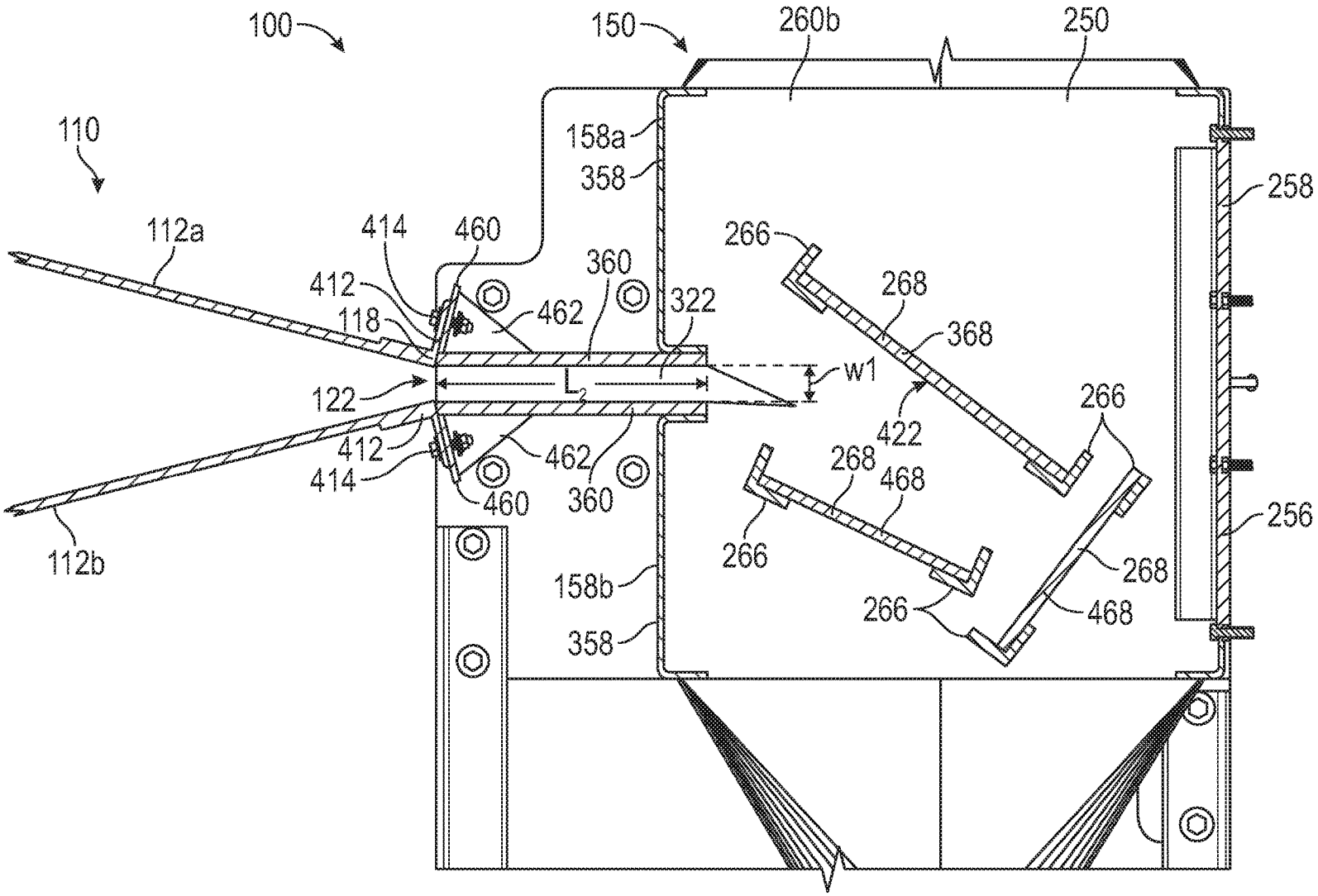
FIG. 4 is a detailed cross-sectional view of a trap compartment of the horizontal bullet trap of FIG. 1.

FIG. 4 is a detail cross-sectional view of the horizontal bullet trap 100 of FIG. 1. As shown, the throat plates 158*a,b* can each respectively comprise a mounting bar 460 attached to the respective throat portion 360 distal from each respective face portion 358. A plurality of gussets 462 can reinforce the mounting bar 460 relative to the throat portion 360. Each funnel plate 112*a,b* can comprise a funnel plate mount 412 disposed as the second end 118 of the funnel assembly 110. The funnel plate mounts 412 can be secured to the mounting bars 460 by a plurality of fasteners 414 to secure the funnel assembly 110 to the trap body 150. This construction can allow the funnel assembly 110 to be detached from the trap body 150 during shipping and installation, as well as if the funnel plates 112*a,b* require replacement. Attachment by fasteners also can reduce the amount of welding required during fabrication and installation.

The throat plates 158*a,b* can also be sized to set a throat length $L_2$ and a throat width $W_1$ of the throat 322. The throat length $L_2$ and the throat width $W_1$ can be designed to set a maximum angular deflection at which a bullet can enter the trap compartment 250, measured relative to a horizontal plane in this aspect. Increasing the throat length $L_2$ or reducing the throat width $W_1$ can reduce the maximum allowable angular deflection of a bullet entering the trap compartment 250, measured relative to the horizontal plane. The position and angle of the primary baffle plate 368 can be oriented to be the first baffle plate 268 struck by an incoming bullet, and the primary baffle plate 368 can be angled relative to the throat 322 to vertically redirect the bullet downwards towards a one of the secondary baffle plates 468 of the plurality of baffle plates 268. By angling the primary baffle plate 368 downwards, the bullet or bullet fragments can also be prevented from ricocheting back through the throat 322 and out of the inlet 122 towards the shooter. In the present aspect, bullets striking the primary baffle plate 368 can be linearly redirected wherein the bullet is redirected along a straight path at a different angle from the initial trajectory, unlike a snail-trap design which redirects the bullet into a circular or circumferential path within a circular bore of the snail trap.

In some aspects, the primary baffle plate 368 can comprise a thicker or harder material than the secondary baffle plates 468 which can reduce the weight and cost of the secondary baffle plates 468. For example and without limitation, in some aspects, the primary baffle plate 368 can comprise ½" steel, and the secondary baffle plates 468 can comprise a thinner material, such as ⅜" steel for example and without limitation. In other aspects, the primary baffle plate 368 can comprise a harder material, such as AR500 grade steel for example and without limitation, and the secondary baffle plates 468 can comprise a softer material, such as AR400 steel, for example and without limitation.

In the present aspect, the trap body 150 can comprise three baffle plates 268; however, in other aspects, the trap body 150 can comprise greater or fewer baffle plates 268. In the present aspect, the baffle plates 268 can be secured to the baffle plate supports 266 with fasteners 966 (fasteners 966 shown in aspect of FIG. 9), such as bolts, screws, rivets, or any other suitable fasteners. As previously described, in the present aspect, the baffle plate supports 266 can be permanently attached to the respective end plates 260*a,b* (end plate 260*a* shown in FIG. 1), such as through welding. In other aspects, the baffle plate supports 266 can be detachable from the end plates 260*a,b*, such as by attachment through a removable fastener for example and without limitation. In such aspects, the baffle plate supports 266 may be permanently attached to the baffle plates 268, such as by welding, and the baffle plate supports 266 can be removed with the respective baffle plate 268.

Figure 5:
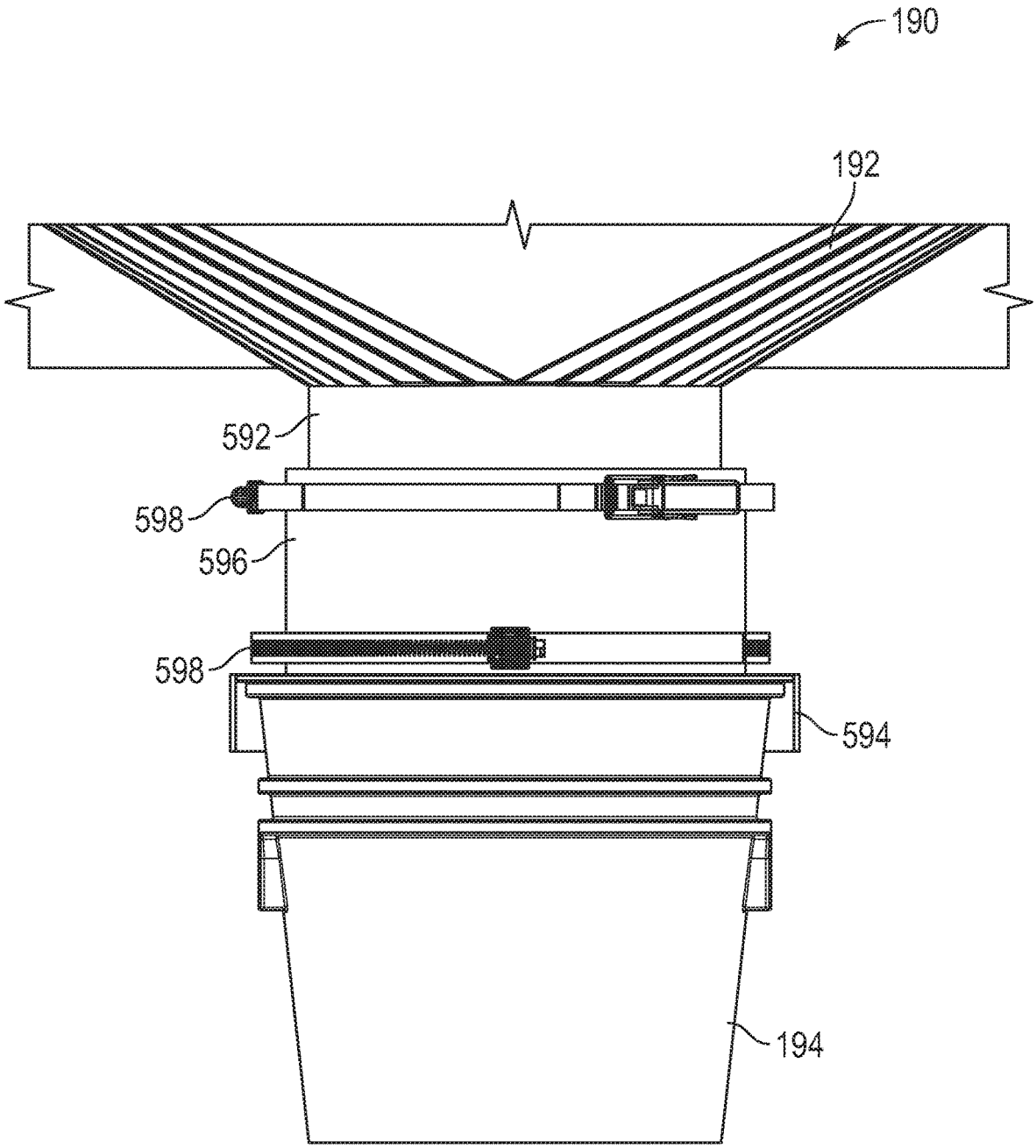
FIG. 5 is a detailed rear view of a collection assembly of the horizontal bullet trap of FIG. 1.

FIG. 5 is a detailed rear view of the collection assembly 190 of the horizontal bullet trap 100 of FIG. 1. In the present aspect, the collection pan 192 can define a collection neck 592 which can be a substantially cylindrical stub. The collection neck 592 can be joined to a bucket adapter 594 by a collection sleeve 596. The collection sleeve 596 can comprise a resilient material, such as a rubber, elastomer, soft plastic, or other suitable material, which can slip over the collection neck 592 and an upper portion of the bucket adapter 594 to secure the bucket adapter 594 to the collection pan 192. The collection assembly 190 can further comprise a pair of hose clamps 598 which can ensure an air-tight seal between the collection sleeve 596 and each of the collection neck 592 and the bucket adapter 594. The bucket adapter 594 can allow for quick attachment and detachment of the collection bucket 194 in order to periodically empty collected bullets, fragments, and particles from the collection bucket 194. The bucket adapter 594 can also provide an air-tight seal with the collection bucket 194 so that lead and other hazardous particles cannot escape the horizontal bullet trap 100.

In some other aspects, the collection bucket 194 can be replaced with a sealed conveyor system to eliminate the need to periodically empty the collection bucket 194. In other aspects, the collection assembly 190 can comprise a dust trap, such as a cyclonic dust trap, to separate bullets and larger fragments from smaller particles.

Figure 6:
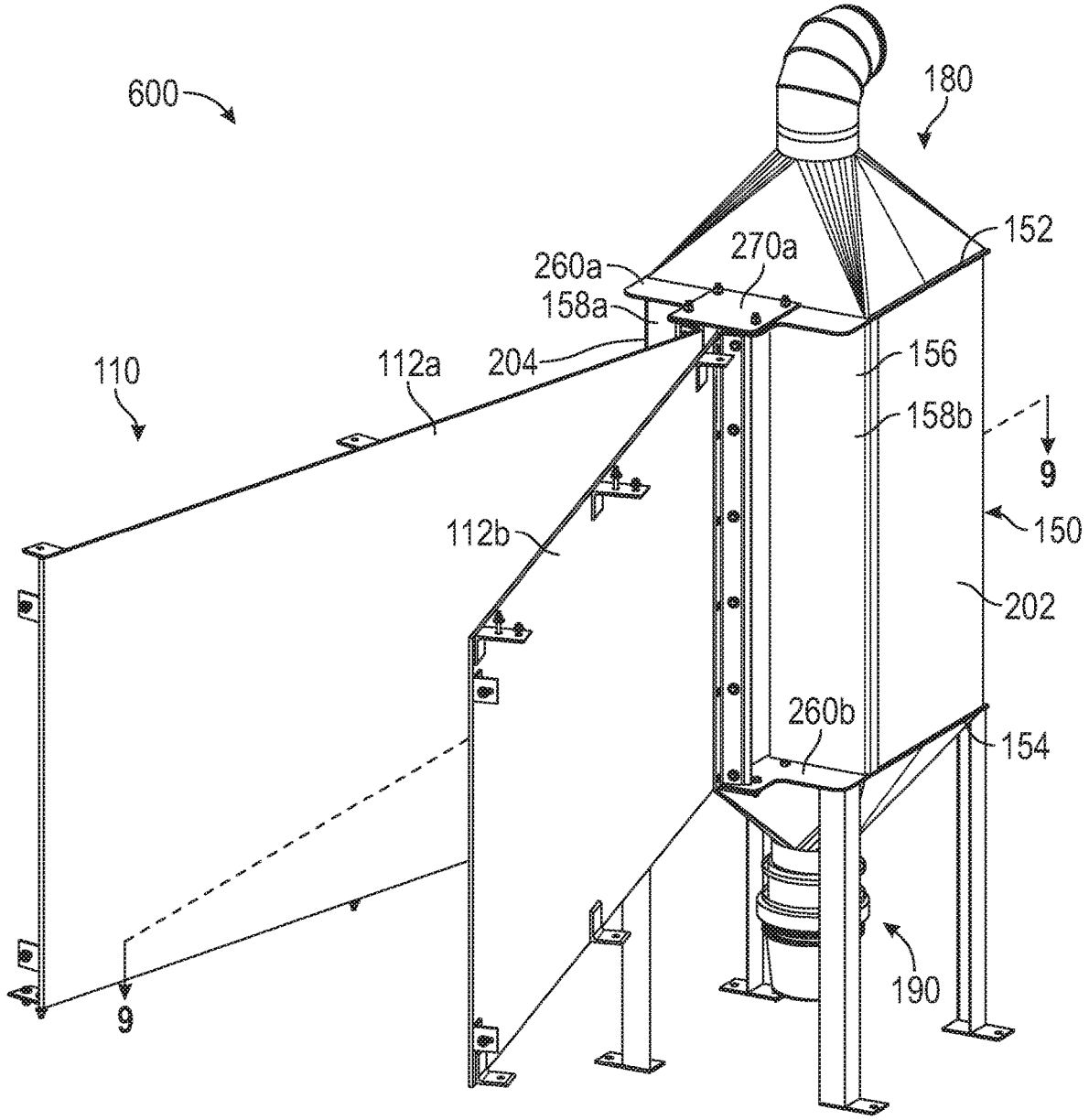
FIG. 6 is a front perspective view of a vertical bullet trap in accordance with another aspect of the present disclosure.

FIG. 6 shows a front perspective view of a vertical bullet trap 600. Externally, the vertical bullet trap 600 can be similar to the horizontal bullet trap 100 (shown in FIG. 1) with the exception that the funnel assembly 110 is rotated 90° to a vertical rather than horizontal orientation along with the throat plates 158*a,b* of the front side 156 of the trap body 150. Additionally, the end plates 260*a,b* and the throat cap plates 270*a,b* (throat cap plate 270*b* shown in FIG. 8) can be disposed at the trap top end 152 and the trap bottom end 154, respectively, rather than at the sides 202,204 of the trap body 150. In the present aspect, the throat cap plates 270*a,b* and the end plates 260*a,b* can each be in a horizontal orientation. In this aspect, the vent assembly 180 can be positioned over the end plate 260*a*, and the collection assembly 190 can be positioned under the end plate 260*b*. The aspects of the trap body 150 of the present aspect are taller and narrower than the trap body 150 of the horizontal bullet trap 100 to accommodate the vertically-oriented funnel assembly 110; however, the height, width, and depth of the trap body 150 should not be viewed as limiting.

One key distinction is that the vertical bullet trap 600 can be desirable for its reduced footprint. For example, the vertical bullet trap 600 can be best suited for a range with a limited number of side-by-side shooting lanes, such as one or two lanes. By comparison, a single horizontal bullet trap 100 can be horizontally widened or shortened during design and fabrication to accommodate greater or fewer side-by-side shooting lanes, and multiple horizontal bullet traps 100 can more easily be installed immediately adjacent to one another to create a range as wide as desired.

Figure 7:
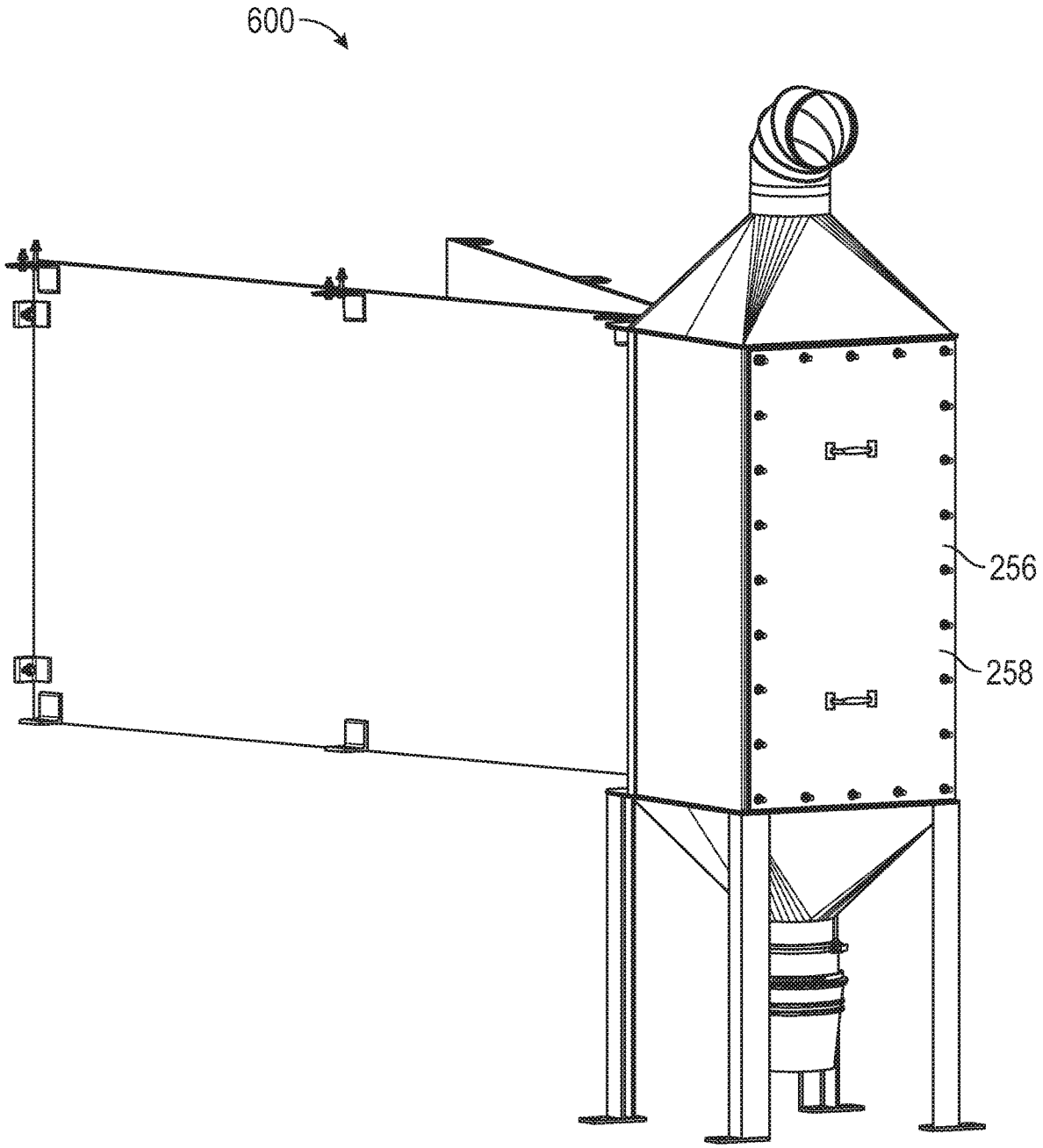
FIG. 7 is a rear perspective view of the vertical bullet trap of FIG. 6.

FIG. 7 is a rear perspective view of the vertical bullet trap 600 of FIG. 6. In the present aspect, the back plate 258 may not be a transparent back plate. Instead, the back plate 258 can comprise a material such as AR steel, titanium, kevlar composite, or another suitable material. Generally, non-transparent materials can be more durable than transparent bullet proof materials, and in the most demanding applications, such as high-power rifle service, it can be desirable for the back plate 258 to comprise a material, such as AR500 steel for example and without limitation, as an additional safety measure in the event that one of the baffle plates 268 (shown in FIG. 2) should fail.

Figure 8:
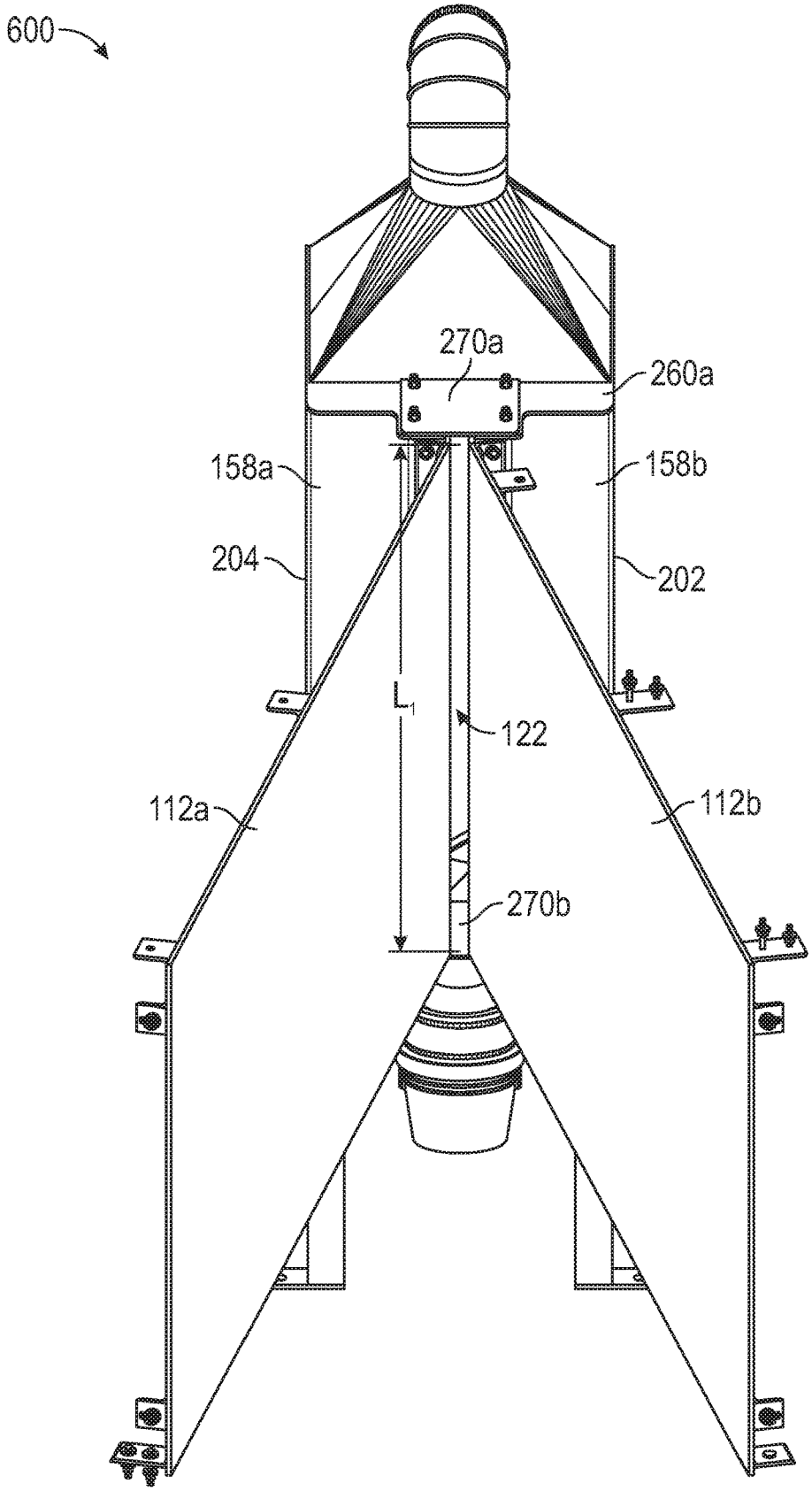
FIG. 8 is a front downward view of an inlet of the vertical bullet trap of FIG. 6.
Figure 9:
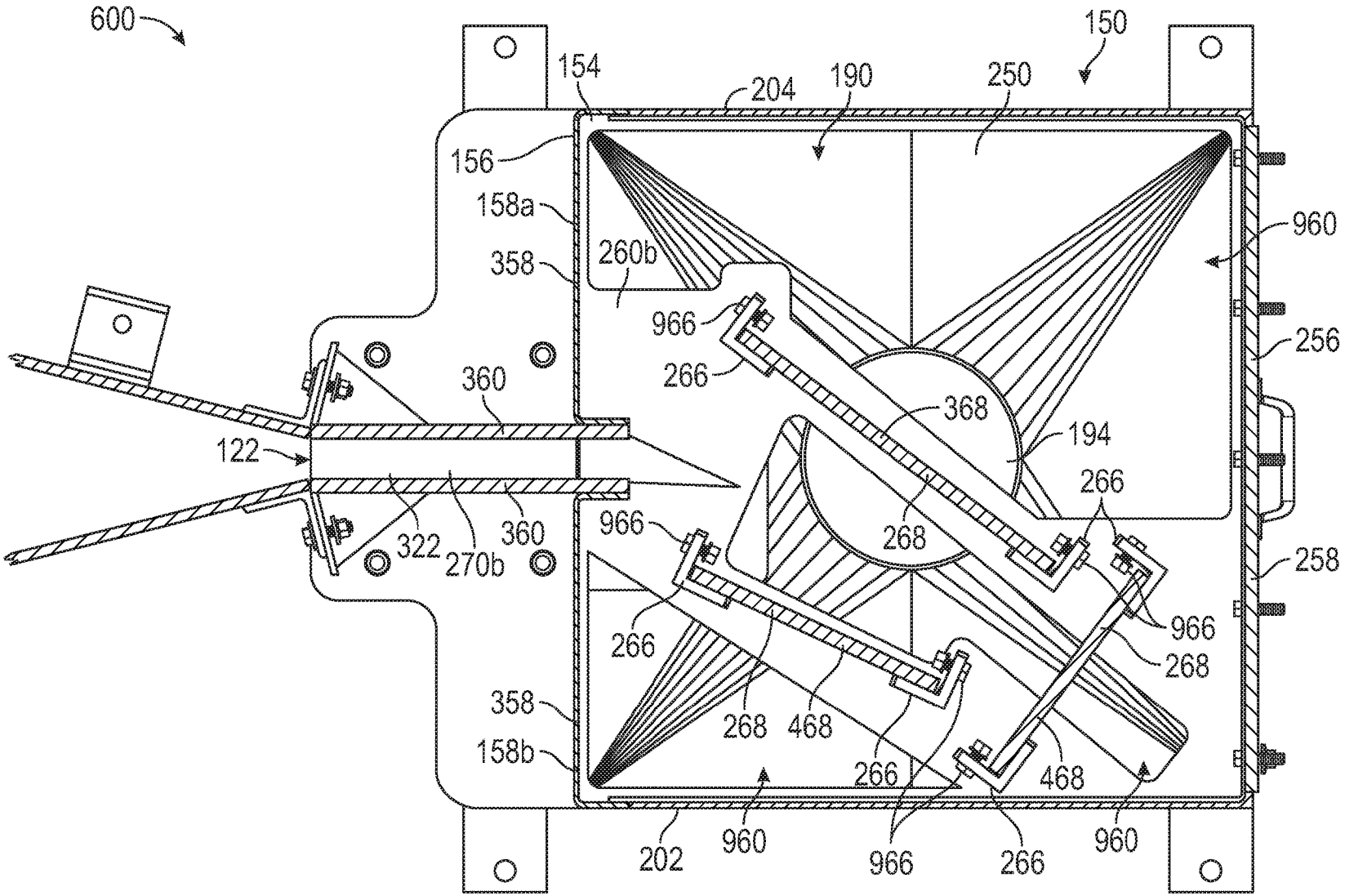
FIG. 9 is a cross-sectional view of a trap compartment of the vertical bullet trap of FIG. 6 taken along line 9-9 as shown in FIG. 6.

FIG. 8 is a front downward view of the vertical bullet trap 600 of FIG. 6 which illustrates the vertical orientation of the throat plates 158*a,b*, the funnel plates 112*a,b*, and the length $L_1$ of the inlet 122, and the horizontal orientation of the throat cap plates 270*a,b* and the end plates 260*a,b* (end plate 260*b* shown in FIG. 9). The throat plate 158*a* can extend between the inlet 122 and the side 204, and the throat plate 158*b* can extend between the inlet 122 and the side 202.

FIG. 9 is a downward cross-sectional view of the vertical bullet trap 600 of FIG. 6 taken along line 9-9 shown in FIG. 6. As shown, the end plate 260*b* can be positioned in the horizontal orientation within the trap compartment 250 at the trap bottom end 154. In aspects wherein the end plates 260*a,b* (end plate 260*a* shown in FIG. 6) are positioned in the horizontal orientation, such as for the vertical bullet trap 600, the end plates 260*a,b* can be skeletonized and can define one or more voids 960. In the present aspect, the end plates 260*a,b* can extend from the front side 156 to the back side 256 of the trap body 150, and voids 960 can be defined between the end plates 260*a,b* and each of the opposite sides 202,204 of the trap body 150. In other aspects, the end plates 260*a,b* can extend between the opposite sides 202,204 or any combination of the opposite sides 202,204, the front side 156, and the back side 256.

The voids 960 can be configured to allow bullets stopped by the baffle plates 268 to fall downwards through the voids 960 to be collected within the collection bucket 194 of the collection assembly 190. Similarly, the voids 960 can provide for ventilation through the trap compartment 250 and upwards and outwards from the trap compartment 250 through the vent assembly 180 (vent assembly 180 shown in FIG. 6).

The baffle plates 268 can be attached to the baffle plate supports 266 by the fasteners 966. In the present aspect, the fasteners 966 can be installed so that opposing sides of each baffle plate 268 are secured between the fasteners 966 and a flange of the baffle plate supports 266. In this configuration, the baffle plates 268 can have limited movement relative to the baffle plate supports 266 which can soften the impulse against each baffle plate 268 when impacted by a bullet. This arrangement can also transfer less of the impulse to the fasteners 966 to limit the wear and tear on each. In other aspects, the fasteners 966 may extend through both the baffle plate 268 and the baffle plate support 266 to directly secure each of the baffle plates 268 to the respective baffle plate support 266. In the present aspect, the fasteners 966 can comprise Society of Automotive Engineers ("SAE") Grade 8 bolts; however, in other aspects, the fasteners 966 can be higher or lower in strength than SAE Grade 8 bolts or can comprise components manufactured to other standards, such as Metric Class 10.9 or 12.9 or American Society for Testing and Materials ("ASTM") standards.

The baffle plates 268 can be in a vertical orientation in the vertical bullet trap 600. In the vertical orientation, the primary baffle plate 368 can be configured to horizontally redirect a bullet fired through the inlet 122 and the throat 322 into the trap compartment 250. In the present aspect, a bullet impacting the primary baffle plate 368 can be horizontally redirected to the right (when viewing the vertical bullet trap 600 from the front side 156) towards the secondary baffle plates 468. In other aspects, the primary baffle plate 368 can be positioned to horizontally redirect the bullet to the left.

Both the horizontal bullet trap 100 and the vertical bullet trap 600 can be at least partially disassembled, such as to facilitate installation, removal, maintenance, or upgrade in a shooting range facility. For example, at least the legs 102, the funnel plates 112*a,b*, the end plates 260*a,b*, the throat cap plates 270*a,b*, and the back plate 258 can be secured by removable fasteners in some aspects. This construction can reduce the welding required to fabricate the traps 100,600 as well as to simplify on-site assembly once delivered. Additionally, many of the components, such as the baffle plates 268, the end plates 260*a,b*, and the throat cap plates 270*a,b* for example and without limitation, can comprise simple shapes cut from plate which can reduce manufacturing and fabrication costs. Other components, such as the legs 102 and baffle plate supports 266 for example and without limitation, can be formed from stock shapes, such as angle iron or steel angle, which can also reduce manufacturing costs.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A bullet trap comprising:

a trap body defining a trap compartment, the trap body comprising a baffle plate enclosed within the trap compartment, the baffle plate being substantially centered within the trap compartment; and a funnel assembly defining an inlet, the inlet aligned with the baffle plate; and wherein the trap body comprises a first throat plate and a second throat plate, the first throat plate aligned substantially parallel to the second throat plate;

wherein the first throat plate and the second throat plate define a throat;

wherein the throat extends from the inlet of the funnel assembly to the trap compartment, the throat defining a throat length and a throat width, the throat length extending from the inlet to the trap compartment, the throat width defined between the first throat plate and the second throat plate, and the throat length being greater than the throat width, the first throat plate and the second throat plate extending at least partially into the trap compartment; and wherein:

the funnel assembly comprises a first funnel plate and a second funnel plate;

the funnel assembly defines a mouth at a first end of the funnel assembly;

the inlet is defined at a second end of the funnel assembly; and the first funnel plate and the second funnel plate angle inwards towards one another from the first end to the second end.

2. The bullet trap of claim 1, wherein the trap compartment is fully enclosed except for the inlet.

3. The bullet trap of claim 1, wherein the trap compartment is fully enclosed except for the inlet and a vent assembly, the vent assembly attached to a top trap end of the trap body.

4. The bullet trap of claim 1, wherein the trap body further comprises a pair of throat cap plates, and wherein the throat cap plates enclose opposite ends of the throat.

5. The bullet trap of claim 1, further comprising a collection assembly attached to a trap bottom end of the trap body, the collection assembly configured to collect bullets falling downward through the trap compartment.

6. The bullet trap of claim 5, wherein a collection assembly comprises:

a collection pan attached to the trap bottom end, and a collection bucket positioned below the collection pan, the collection pan sloped inward and downwards towards the collection bucket, the collection bucket detachable from the collection pan.

7. The bullet trap of claim 1, wherein:

the first throat plate defines a first face portion and a first throat portion;

the first throat portion extends outwards from the first face portion;

the second throat plate defines a second face portion and a second throat portion;

the second throat portion extends outwards from the second face portion; and the first throat portion and the second throat portion define the throat.

8. The bullet trap of claim 1, wherein the first throat plate and the second throat plate extend outward from a front side of the trap body, and wherein the first throat plate and the second throat plate attach to the second end of the funnel assembly.

9. The bullet trap of claim 1, wherein:

the baffle plate engages a baffle support;

the baffle support comprises a first portion and a second portion;

the first portion is substantially perpendicular to the second portion;

the baffle plate rests against the first portion;

a fastener extends through the second portion; and an end of the baffle plate is retained between the fastener and the first portion.

10. The bullet trap of claim 1, wherein:

the trap body defines a top trap end and a bottom trap end;

a trap height is defined between the top trap end and the bottom trap end; and a value of the throat width is less than half of a value of the trap height.

11. A trap body, the trap body comprising:

a front side, the front side defining a throat between a first throat plate and a second throat plate of the trap body, the first throat plate aligned substantially parallel with the second throat plate, the throat extending to a trap compartment, the trap compartment defined within the trap body, the throat being substantially centered relative to the trap compartment, the throat defining a throat length and a throat width, the throat length defined substantially perpendicular to the front side, the throat width defined between the first throat plate and the second throat plate, the throat length being greater than the throat width;

a back side, the back side disposed opposite from the front side, the back side being substantially parallel to the front side;

a pair of end plates, each end plate of the pair of end plates extending from the front side to the back side; and a baffle plate enclosed within the trap compartment, the baffle plate extending between the pair of end plates; and wherein a collection assembly is attached to a bottom trap end of the trap body, the collection assembly configured to collect bullets from the trap compartment.

12. The trap body of claim 11, wherein a vent assembly is attached to a top trap end of the trap body, the vent assembly configured to vent air outwards from the trap compartment.

13. The trap body of claim 11, further comprising a pair of baffle supports, a first baffle support of the pair of baffle supports attached to a first end plate of the pair of end plates, a second baffle support of the pair of baffle supports attached to a second end plate of the pair of end plates, the baffle plate secured to the first baffle support and the second baffle support.

14. The trap body of claim 11, wherein at least one end plate of the pair of end plates is skeletonized and defines at least one void.

15. The trap body of claim 11, wherein the throat is defined substantially perpendicular to the back side.

* * * * *